US006034518A

United States Patent [19]

Yuasa

[11] Patent Number: 6,034,518

[45] **Date of Patent: *Mar. 7, 2000**

[54] STABILIZED CURRENT MIRROR CIRCUIT

[75] Inventor: Tachio Yuasa, Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/965,244

[22] Filed: Nov. 6, 1997

[30] Foreign Application Priority Data

Feb. 13, 1997 [JP] Japan ..... 9-029321

[51] Int. Cl.[7] ..... G05F 3/16

[52] U.S. Cl. ..... 323/316; 323/315

[58] Field of Search ..... 323/313, 314, 323/316, 315

[56] References Cited

U.S. PATENT DOCUMENTS

| | | | |
|---|---|---|---|
| 4,398,160 | 8/1983 | Neidorff | 323/316 |
| 4,814,724 | 3/1989 | Tanigawa | 323/315 |
| 5,164,658 | 11/1992 | Kuwahara | 323/315 |
| 5,633,612 | 5/1997 | Lee | 323/315 |
| 5,801,523 | 9/1998 | Bynum | 323/315 |

OTHER PUBLICATIONS

Wilson; "Recent Developments In Current Conveyors And Current–Mode Circuits"; IEEE Proceedings, vol. 137, No. 21 Apr. 1990, pp. 63–77.

*Primary Examiner*—Jeffrey Sterrett
*Attorney, Agent, or Firm*—Armstrong, Westerman, Hattori, McLeland & Naughton

[57] ABSTRACT

A stabilized current mirror circuit including a current mirror circuit 10 having an input-stage nMOS transistor 11 and an output-stage nMOS transistor 12, an error amplifier 30 in which an output current I3 decreases in response to the rise of an output potential V2 of the output-stage nMOS transistor 12 above a specified value, a current mirror circuit 20 having an input-stage pMOS transistor 22 through which the current I3 flows and an output-stage pMOS transistor 21 connected in series to the output-stage nMOS transistor 12 and an nMOS transistor 42 connected between the output-stage pMOS transistor 21 and the output-stage nMOS transistor 12. An nMOS transistor 41 connected at a current input provides a bias voltage to the gate of the nMOS transistor 42 to enable the nMOS transistor 42 to function as a norator.

8 Claims, 5 Drawing Sheets

STABILIZED CURRENT MIRROR CIRCUIT

BACKGROUND OF THE INVENTION

1. Field of the Invention

The present invention relates to a stabilized current mirror circuit.

2. Description of the Related Art

FIG. 5 shows a prior art current mirror circuit.

Current mirror circuit 10 consists of input-stage nMOS transistor 11 which has the diode connection and output-stage nMOS transistor 12. Current I1 is provided to nMOS transistor 11 as an input signal. The output current I2 of current mirror circuit 10 is also the input for the pMOS transistor 21 which has the diode connection. pMOS transistor 21, for example, is also an input-stage for another current mirror circuit, and gate potential VB of pMOS transistor 21, in this case, is provided to the gate of a pMOS transistor (not illustrated) on the output-stage of this current mirror circuit.

In an ideal case where nMOS transistors 11 and 12 have the same characteristics and output potential V2 (Drain potential) of nMOS transistor 12 is equal to drain potential V1 of nMOS transistor 11, I1 is equal to I2. However, as described below, V1 and V2 are not equal in general.

Since nMOS transistor 11 has the diode connection, namely its gate is short-circuited to its drain, drain voltage V1 is about the threshold voltage Vthn of nMOS transistor 11. Since pMOS transistor 21 has also the diode connection, drain voltage (VDD−V2) of pMOS transistor 21 is about Vthp which is the absolute value of the threshold voltage of pMOS transistor 21.

As a general numeric example, if VDD=3.0 V, and Vthn=Vthp=1.0 V, then, V1=1.0 V and V2=2.0 V, and thus, I1<I2.

Establishing V1=V2 and I1=I2 is an ideal example, and generally it is ideal to make constant the transfer characteristics of current mirror circuits, namely to have no variations in those characteristics.

However, if threshold voltage Vthp is varied or the saturation characteristics of MOS transistors are changed due to variations in the manufacturing processes, there exist variations in the output potentials of current mirror circuits. The variations of output potential V2 due to that becomes conspicuous according to the miniaturization of the circuit elements of integrated circuits. Also, output potential V2 is affected by variations in power supply voltage VDD or temperature.

SUMMARY OF THE INVENTION

Accordingly, an object of the present invention is to provide a stabilized current mirror circuit in which transfer characteristics is constant even if there exist variations in manufacturing process.

In the first aspect of the present invention, as shown in FIG. 1(A) or FIG. 1(B) for example, there is provided a stabilized current mirror circuit comprising: a first current mirror circuit (1), having a first input-stage transistor, and a first output-stage transistor operably connected to the first input-stage transistor; an error amplifier, its output current changing in response to a variation of an output potential of the first-output-stage transistor; and a second current mirror circuit (2), having a second input-stage transistor through which the output current flows, having a second output-stage transistor operably connected to the second input-stage transistor, the second output-stage transistor being connected to the first output-stage transistor in series.

There are two ways in which this stabilized current mirror circuit operates in accordance with its construction. If the construction is, for example, as shown in FIG. 2(A), it operates as will be described in section 1) below, and if the connection is one in which, for example in FIG. 2(A), pMOS transistors and nMOS transistors are interchanged with each other and power supply potential VDD and ground potential are interchanged with each other, it operates as will be described in section 2) below.

1). If an output voltage (V2) of the first output-stage transistor is greater than a designed value due to variations in manufacturing processes, power supply voltage or temperature, the current (I3) which flows through the second input-stage transistor decreases. Then, the current which flows through the second output-stage transistor decreases. Therefor, the current (I2) which flows through the first output-stage transistor decreases and at the same time the output potential (V2) of the first output-stage transistor falls.

If an output voltage (V2) of the first output-stage transistor is less than the designed value due to the above-described variations, the current (I3) which flows through the second input-stage transistor increases. Then, the current which flows through the second output-stage transistor increases. Therefor, the current (I2) which flows through the first output-stage transistor increases and at the same time the output potential (V2) of the first output-stage transistor rises.

2). If an output voltage (V2) of the first output-stage transistor is greater than the designed value due to the above-described variations, the current (I3) which flows through the second input-stage transistor increases. Then, the current which flows through the second output-stage transistor increases. Therefor, the current (I2) which flows through the first output-stage transistor increases and at the same time the output potential (V2) of the first output-stage transistor falls.

If an output voltage (V2) of the first output-stage transistor is less than the designed value due to the above-described variations, the current (I3) which flows through the second input-stage transistor decreases. Then, the current which flows through the second output-stage transistor decreases. Therefor, the current (I2) which flows through the first output-stage transistor decreases and at the same time the output potential (V2) of the first output-stage transistor rises.

Accordingly, with the first aspect of the present invention, even if the transfer characteristics of the first or second current mirror circuit (1 or 2) varies from a desired one, and therefor the potential (V2) of the first output-stage transistor falls or rises, the error amplifier (3) operates so that this potential (V2) approaches a desired value, and at the same time, the output-stage potential (VB) of the second input-stage transistor also operates to approach a desired value. These potentials (V2 and VB) are stabilized by the above stabilizing operation. With this, the output current (I2) of the first current mirror circuit and the input current (I3) of the second current mirror circuit I3 are stabilized. In other words, with this current (I2 and I3) stabilization, the above potentials (V2 and VB) are also stabilized.

In the second aspect of the present invention, as shown in FIG. 1(B) for example, there is provided a stabilized current mirror circuit according to the first aspect, further comprising a norator (4) connected between the first output-stage transistor and the second output-stage transistor for making a current substantially constant between its input and its output.

Depending on the power supply voltage, the ideal condition that the input and output potentials of the first current mirror circuit (1) have a specified relation and that the input and output potentials of the second current mirror circuit (2) have a specified relation, cannot be satisfied. However, since the norator is inserted in this stabilized current mirror circuit, the required conditions can be satisfied substantially. With this norator, error correction precision will be increased, and an application range of the present invention will be extended.

In the third aspect of the present invention, as shown in FIG. 2(A) or FIG. 3(A) for example, there is provided a stabilized current mirror circuit according to the first aspect, wherein the error amplifier (30) comprises: an error detector transistor (34), its gate being adapted to receive an output potential of the first or second output-stage transistor; and a third current mirror circuit (33), having a third input-stage transistor connected to the error detector transistor in series, having a third output-stage transistor operably connected to the third input-stage transistor and connected to the second input-stage transistor in series.

In the fourth aspect of the present invention, as shown in FIG. 2(B) or FIG. 3(B) for example, there is provided a stabilized current mirror circuit according to the first aspect, wherein the error amplifier (30A) comprises: an error detector transistor (34), its gate being adapted to receive an output potential of the first or second output-stage transistor (12 or 21); and a third output-stage transistor (31), connected to the error detector transistor (34) in series, operably connected to the first input-stage transistor (11) to configure substantially a third current mirror circuit together with the first input-stage transistor (11); and a transistor (32), connected to the second input-stage transistor (22) in series, its control input being adapted to receive a potential between the error detector transistor (34) and the third output-stage transistor (31).

In the fifth aspect of the present invention, as shown in FIG. 3(A) or FIG. 3(B) for example, there is provided a stabilized current mirror circuit according to the second aspect, wherein the norator is a fourth output-stage transistor (42) of a fourth current mirror circuit (40).

In the sixth aspect of the present invention, as shown in FIG. 3(A) or FIG. 3(B) for example, there is provided a stabilized current mirror circuit according to the fifth aspect, wherein the fourth current mirror circuit (40) further comprises a fourth input-stage transistor (41), connected to the first input-stage transistor in series, operably connected to the fourth output-stage transistor.

In the seventh aspect of the present invention, there is provided a stabilized current mirror circuit according to the first aspect, wherein the first input-stage transistor itself is connected to make a diode, and a control input of the first output-stage transistor is connected to a control input of the first input-stage transistor; and wherein the second input-stage transistor itself is connected to make a diode, and a control input of the second output-stage transistor is connected to a control input of the second input-stage transistor.

In the eighth aspect of the present invention, there is provided a stabilized current mirror circuit according to the seventh aspect, wherein each of the first input-stage transistor and the first output-stage transistor is one of a pMOS transistor and a nMOS transistor; and wherein each of the second input-stage transistor, the second output-stage transistor and the error detection transistor is the other of a pMOS transistor and a nMOS transistor.

DESCRIPTION OF THE PREFERRED EMBODIMENTS

Figure 1A:
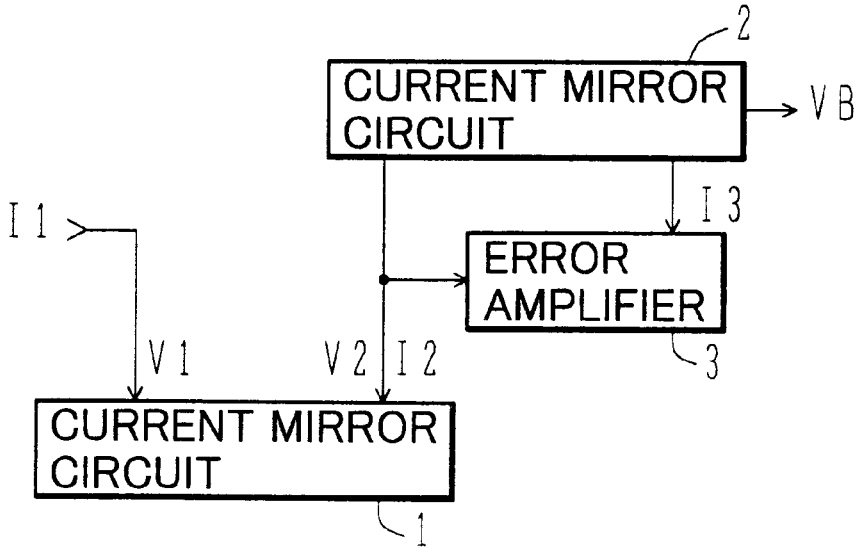
FIGS. 1(A) and 1(B) are block diagrams showing stabilized current mirror circuits according to the present invention.

Referring now to the drawings, wherein like reference characters designate like or corresponding parts throughout several views, preferred embodiments of the present invention are described below.

First Embodiment

Figure 2A:
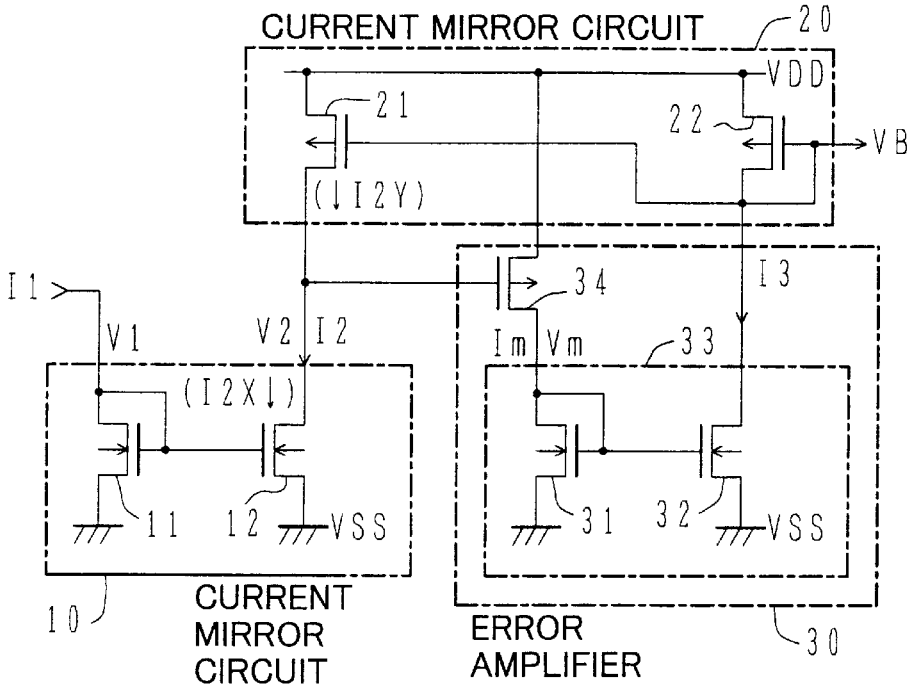
FIGS. 2(A) and 2(B) are circuit diagrams showing embodiments of the circuit of FIG. 1(A)

FIG. 2(A) shows the first embodiment according to the stabilized current mirror circuit of FIG. 1(A).

Current mirror circuit 10 consists of input-stage nMOS transistor 11 having diode connection and output-stage nMOS transistor 12. The drain of nMOS transistor 11 is connected to the gate of nMOS transistor 12, and both the sources of nMOS transistors 11 and 12 are connected to a conductor of ground potential VSS.

Current mirror circuit 20 consists of output-stage pMOS transistor 21 and input-stage pMOS transistor 22 having diode connection. The drain of pMOS transistor 22 is connected to the gate of pMOS transistor 21, and both the sources of pMOS transistors 21 and 22 are connected to a conductor of power supply potential VDD.

Error amplifier 30 operates as a current source with high input-impedance and, consists of current mirror circuit 33 having input-stage nMOS transistor 31 and output-stage nMOS transistor 32, and pMOS transistor 34 for error detection. The source, drain, and gate of error detector pMOS transistor 34 are connected to the conductor of power supply potential VDD and the drains of nMOS transistors 31 and 12 respectively.

The gate potential VB of pMOS transistor 22, for example, is provided to the gate of an output-stage pMOS transistor.of another current mirror circuit (not illustrated).

All MOS transistors configuring current mirror circuits 10, 20 and 33 are operated in the saturation region. There are no problems if pMOS transistor 34 is operated within or without the saturation region, but it is usually operated in the saturation region. This condition is applied to other embodiments described below.

Although it is not the condition for establishing the present invention, but for the sake of simplification, assume that the characteristics of paired nMOS transistors 11 and 12 are equivalent, and the characteristics of paired pMOS transistors 21 and 22 are equivalent, and also the characteristics of paired nMOS transistors 31 and 32 are equivalent.

As shown in FIG. 2(A), the drain currents (input/output currents) of nMOS transistors 11 and 12 are designated as I1 and I2, respectively, and their drain potentials (input/output potentials) are designated as V1 and V2, respectively. The drain currents of nMOS transistors 31 and 32 are designated as Im and I3, respectively, and their drain potentials are designated as Vm and VB, respectively.

Next, the operation of the stabilized current mirror circuit configured as described above will be explained below.

Current I1 is provided to nMOS transistor 11 as an input signal for the stabilized current mirror circuit.

(1) In a Case of V2=V2s

Assume that potential V2 is already stabilized at V2s in the meaning as described below even if current mirror circuit 20 and error amplifier 30 are not operating to stabilize.

In the first route, by inputting current I1 to nMOS transistor 11, current I2X which is equal to current I1 tends to flow through nMOS transistor 12. In the second route, in response to potential V2 provided to the gate of pMOS transistor 34, current Im flows through pMOS transistor 34 and nMOS transistor 31, and current I3 equal to current Im flows through nMOS transistor 32 and pMOS transistor 22. Potential VB of this state is transferred to the gate of pMOS transistor 21, and in response to this, current I2Y tends to flow through pMOS transistor 21. When current I2Y is equal to current I2X, V2 is designated as stabilized potential V2s. Assume that the transistor characteristics in FIG. 2(A) are designed to obtain this stabilization.

(2) In a Case of V2>V2s

Assume a case in which V2 is greater than V2s due to variations in the manufacturing processes, power supply potential VDD or temperature.

Compared to the above (1), since the rise of potential V2 reduces current Im which flows through nMOS transistor 31, drain current I3 of nMOS transistor 32 is reduced. The decrease of current I3 causes a fall of drain voltage (VDD−VB) of pMOS transistor 22, that is, a rise of potential VB occurs. Therefor, the internal resistance between the drain and the source of pMOS transistor 21 increases, and consequently drain potential V2 of pMOS transistor 21 falls.

Potential V2 falls with repeating the above loop operation. The fall of potential V2 under V2s causes the reverse operation which will be explained next.

(3) In a Case of V2<V2s

Assume a case in which V2 is less than V2s due to above-described variations.

Compared to the above (1), since the fall of potential V2 increases current Im which flows through nMOS transistor 31, drain current I3 of nMOS transistor 32 is increased. The increase of current I3 causes a rise of drain voltage (VDD−VB) of pMOS transistor 22, that is, a fall of potential VB occurs. Therefor, the internal resistance between the drain and the source of pMOS transistor 21 decreases, and consequently drain potential V2 of pMOS transistor 21 rises.

Potential V2 rises with repeating the above loop operation. The rise of potential V2 over V2s causes the reverse operation (2) described above.

Accordingly, even if transfer characteristics of current mirror circuit 10 or 20 varies from the desired one, and therefor potential V2 falls or rises, error amplifier 30 operates so that the potential V2 approaches the specified value V2s, and at the same time, potential VB operates to approach the specified value. Currents I2 and I3 are stabilized by the above stabilizing operation for potential V2. In other words, when current I2 and I3 are stabilized, output potential VB is also stabilized.

Second Embodiment

Figure 2B:
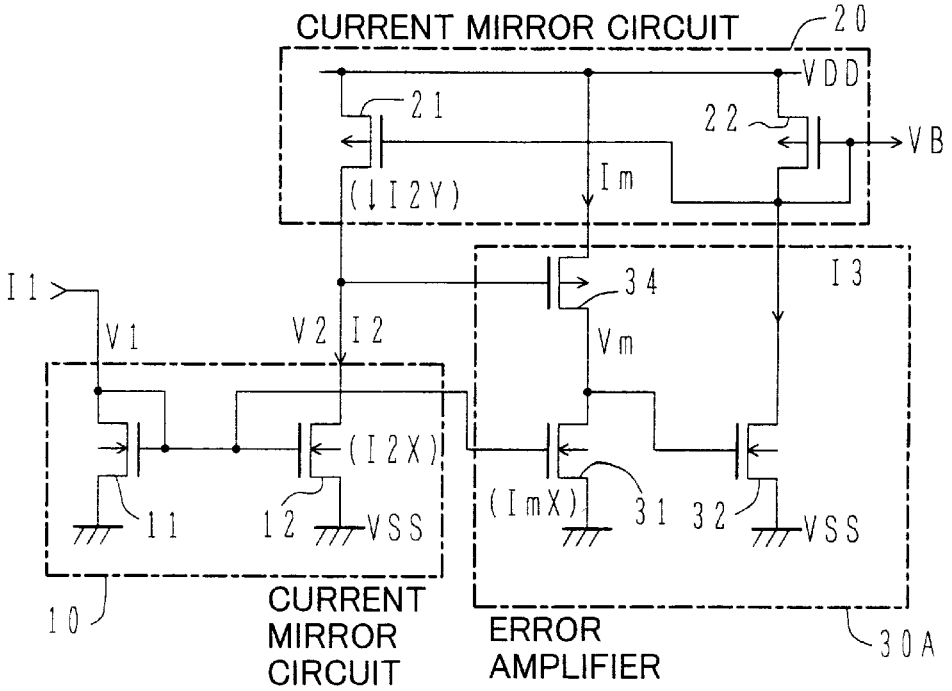

FIG. 2(B) shows the second embodiment according to the stabilized current mirror circuit of FIG. 1(A).

The connection destination of the gate of nMOS transistor 31 is its drain in FIG. 2(A), but in FIG. 2(B), the destination is the gate of nMOS transistor 12. Therefore, nMOS transistor 31 does not configure a current mirror circuit in combination with nMOS transistor 32, but configures a current mirror circuit with nMOS transistor 11. The gate of nMOS transistor 32 is connected to the drain of nMOS transistor 31. Others are the same configuration as of FIG. 2(A).

Next, the operation of the stabilized current mirror circuit configured as described above will be explained below.

Current I1 is provided to nMOS transistor 11 as an input signal for the stabilized current mirror circuit.

(1) In a Case of V2=V2t and Vm=Vmt

Assume that potential V2 and Vm are stabilized respectively at V2t and Vmt in the meaning as described below even if current mirror circuit 20 and error amplifier 30A are not operating to stabilize.

In the first route, by inputting current I1 to nMOS transistor 11, currents I2X and ImX that are approximately equal to current I1 tend to flow through nMOS transistors 12 and 31, respectively. In the second route, in response to potential V2 provided to the gate of pMOS transistor 34, current ImY flows through pMOS transistor 34. In the third route, in response to potential Vm provided to the gate of nMOS transistor 32, current I3 flows through nMOS transistor 32, and this current I3 is also the input current to pMOS transistor 22 of current mirror circuit 20. Then the drain potential VB of pMOS transistor 22 is transferred to the gate of pMOS transistor 21, then current I2Y which is approximately equal to current I3 flows through pMOS transistor 21. When current I2Y is equal to current I2X and current ImY is equal to current ImX, V2 and Vm are designated as stabilized potentials V2t and Vmt, respectively. Assume that the transistor characteristics in FIG. 2(B) are designed to obtain this stabilization.

(2) In a Case of V2>V2t or Vm<Vmt

Assume a case in which V2 is greater than V2t due to above variation. Compared to the above (1), the internal resistance of transistor 34 is increased by the rise of potential V2, therefor, potential Vm falls. Therefor, drain current I3 of nMOS transistor 32 decreases. The decrease of current I3 causes a drop in drain voltage (VDD−VB) of pMOS transistor 22, that is, potential VB rises.

Accordingly, the internal resistance of pMOS transistor 21 increases, and causes a drop in drain voltage V2 of pMOS transistor 21.

Potential V2 falls with repeating the above loop operation. The drop of potential V2 under V2t causes the reverse operation which will be explained below.

If Vm becomes lower than Vmt, the operation is the same as that, after the drop in the potential Vm, descried above, and as a result, this causes a rise of potential Vm.

If V2>V2t and Vm<Vmt occur at the same time, the operation is the same as that described above.

(3) In a case of V2<V2t or Vm>Vmt

Assume a case in which V2 is less than V2t due to the above variation.

Compared to the above (1), the internal resistance of pMOS transistor 34 is decreased by the drop of potential V2, and so, potential Vm rises. So, drain current I3 of nMOS transistor 32 increases. This causes a rise in drain voltage (VDD−VB) of pMOS transistor 22, that is, potential VB falls. Therefore, the internal resistance of pMOS transistor 21 decreases, and causes a rise in drain voltage V2 of pMOS transistor 21.

Potential V2 rises with repeating the above loop operation. The rise of potential V2 over V2t causes the reverse operation (2) described above.

If Vm becomes greater than Vmt, the operation is the same as that, after the rise in the potential Vm, descried above, and as a result, this causes a drop of potential Vm.

If V2<V2t and Vm>Vmt occur at the same time, the operation is the same as that described above.

Accordingly, even if transfer characteristics of current mirror circuit 10 or 20 varies from the desired one, and therefor potential V2 or Vm falls or rises, error amplifier 30A operates so that the potential V2 approaches the specified value V2t, and at the same time, potential VB operates to approach the specified value. Currents I2 and I3 are stabilized by the above stabilizing operation for potential V2. In other words, when currents I2 and I3 are stabilized, output potential VB is also stabilized.

Third Embodiment

As described in the related art column, if power supply voltage VDD is greater than, e.g., 2 V, the ideal condition V2=V1 for current mirror circuit 10, cannot be satisfied. If this condition cannot be met, the ideal condition VB=V2 for current mirror circuit 20, cannot be satisfied either.

Figure 3A:
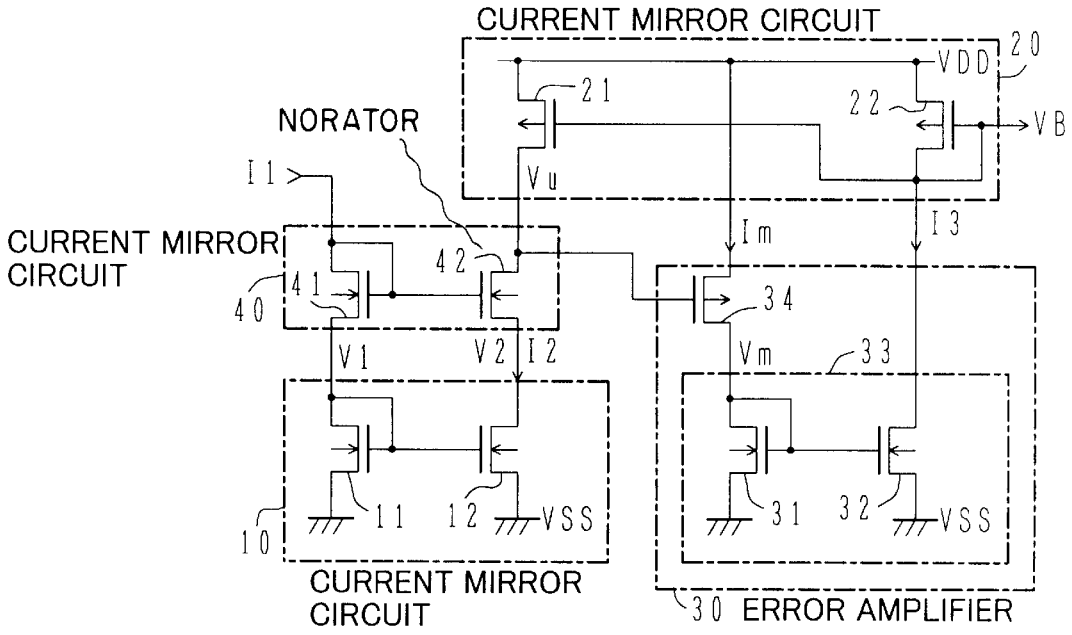
FIGS. 3(A) and 3(B) are circuit diagrams showing embodiments of the circuit of FIG. 1(B)
Figure 3B:
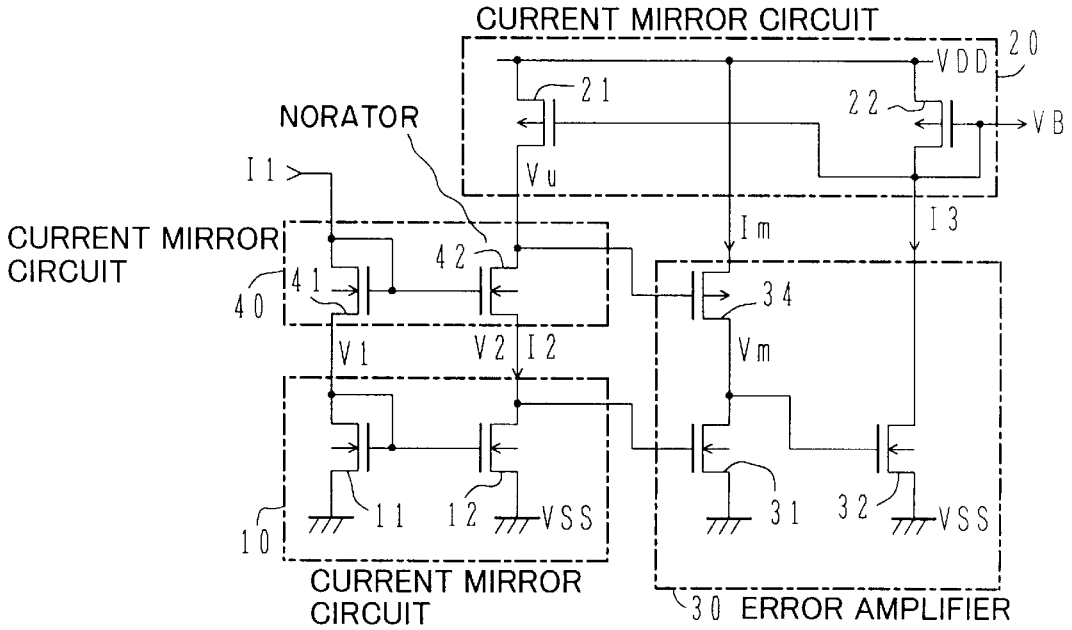

Therefore, to satisfy this condition approximately, the stabilized current mirror circuit of FIG. 3(A) is configured by adding current mirror circuit 40 to the circuit of FIG. 2(A). The circuit of FIG. 3(B) is an embodiment of FIG. 1(B) circuit.

Current mirror circuit 40 consists of input-stage nMOS transistor 41 connected between the drain of nMOS transistor 11 and the input of the stabilized current mirror circuit, and output-stage nMOS transistor 42 connected between the drain of nMOS transistor 12 and the drain of pMOS transistor 21. nMOS transistor 42 is used as a norator in which current is constant without depending on its drain-source voltage, and is operated in the saturation region. nMOS transistor 41 having a diode connection provides a bias voltage to the gate of nMOS transistor 42 so that it can operate as the norator.

The drain potential Vu of pMOS transistor 21 is shifted down to V2 by the norator, and current I2 is not affected by the voltage shift (Vu−V2), so even if power supply voltage VDD is greater than the upper limit, e.g., 2 V of FIG. 2(A) circuit, the ideal condition can be satisfied. The variances of potential V2 and VB from this condition can be corrected by the above-mentioned operation with error amplifier 30 and current mirror circuit.

According to the present embodiment, since the variances of V2 and VB can be reduced by the above voltage shift (Vu−V2), a correction precision is better than that of the configuration of FIG. 2(A), so the application range of the invention can be widened.

Fourth Embodiment

Figure 1B:
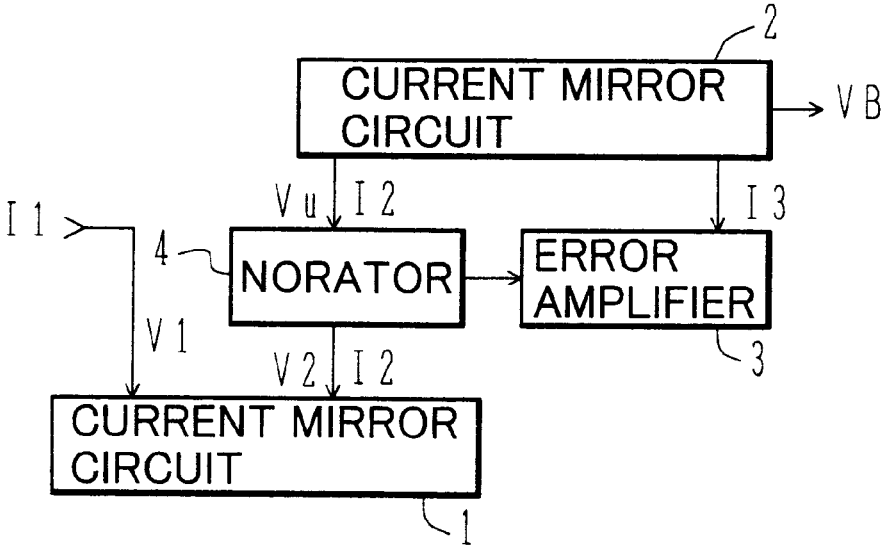

FIG. 3(B) shows a stabilized current mirror circuit which is an embodiment of FIG. 1(B) circuit.

This circuit is a variation of FIG. 3(A) circuit, in which the gate connection destination of nMOS transistor 31 is changed from its drain to the drain of nMOS transistor 12. The same effect as the circuit of FIG. 3(A) has, can be obtained. nMOS transistors 31 and 11 configure substantially a current mirror circuit.

Although preferred embodiments of the present invention has been described, it is to be understood that the invention is not limited thereto and that various changes and modifications may be made without departing from the spirit and scope of the invention.

For example, in FIG. 2(B), it is possible to configure a current mirror circuit substantially consisting of nMOS transistors 12 and 31 by changing the connection destination of the gate of the nMOS transistor 31 to the drain of nMOS transistor 12. Likewise, in FIG. 3(B), it is possible to configure a current mirror circuit substantially consisting of nMOS transistors 12 and 31 by changing the connection destination of the gate of the nMOS transistor 31 to the gate of nMOS transistor 12.

In FIGS. 3(A) or 3(B), it is also possible to make a configuration such that a proper potential is applied to the gate of nMOS transistor 42 from another circuit instead of using nMOS transistor 41. The connection destination of the gate of pMOS transistor 34 may be the source of nMOS transistor 42 that is a current output of the norator.

In the stabilized current mirror circuit of FIGS. 2(A), 2(B), 3(A) or 3(B), it is possible to exchange the nMOS transistors and the pMOS transistors to each other, and power supply potential VDD and ground potential VSS so that the currents flow inversely. In this case, the relation between the shift directions of potential V2 and current I3 from the specified values are inverted when compared with the stabilized current mirror circuit of the corresponding FIGS. 2(A), 2(B), 3(A) or 3(B).

A bipolar transistor can be used as a norator instead of an MOS transistor.

Figure 4:
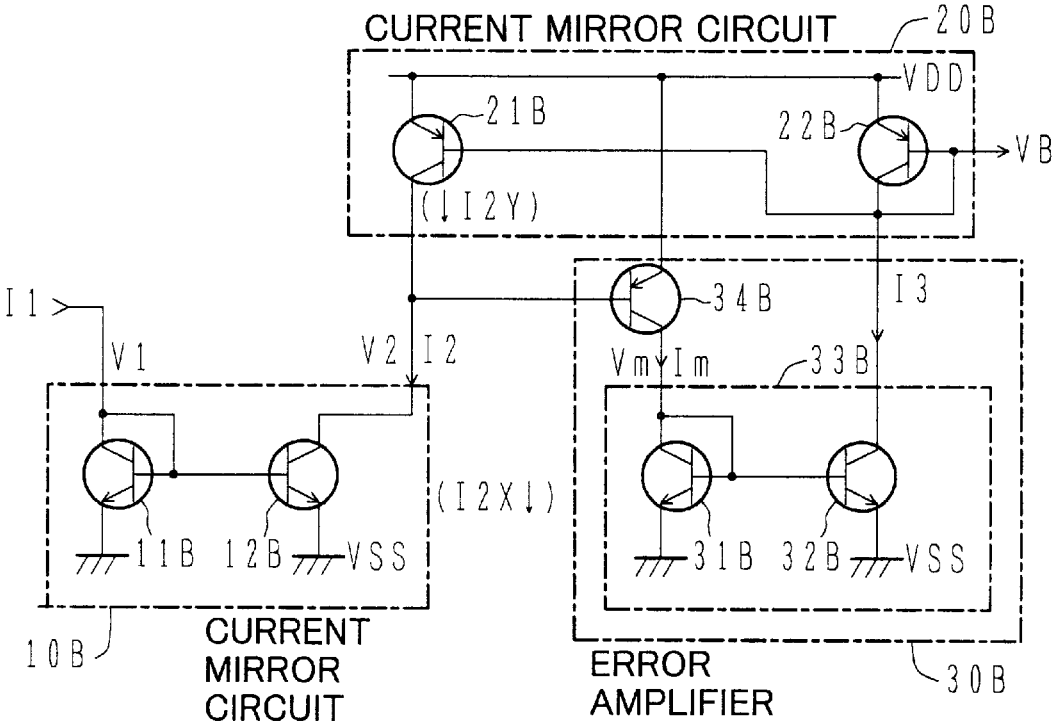
FIG. 4 is a circuit diagram showing a variation of the circuit of FIG. 2(A)
Figure 5:
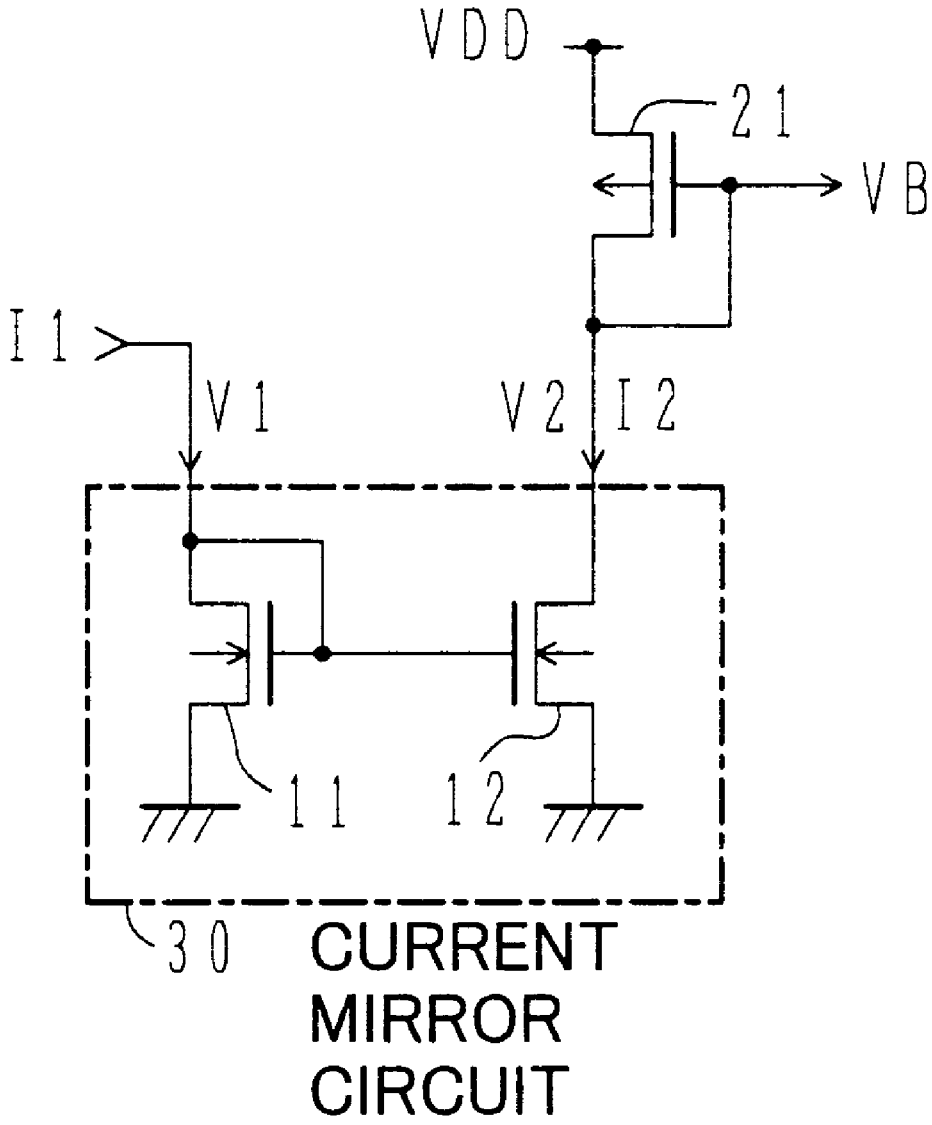
FIG.5 PRIOR ART
FIG. 5 is a prior art current mirror circuit.

It is possible to configure the stabilized current mirror circuit in which pMOS and nMOS transistors are replaced with PNP transistors and NPN transistors, respectively. FIG. 4 shows an example of this replacement corresponding to FIG. 2(A). Each of 11B, 12B, 31B and 32B designates an NPN transistor and each of 21B, 22B and 34B designates a PNP transistor. In addition, it is possible to execute the pMOS/PNP and nMOS/NPN replacement after the above-described nMOS/pMOS and VDD/VSS exchange.

There are various types of known current mirror circuits, and any circuit of them may be used in the present invention.

What is claimed is:

1. A stabilized current mirror circuit comprising:

a first current mirror circuit having a first input-stage transistor and a first output-stage transistor operably connected to said first input-stage transistor;

an error amplifier, its output current changing in response to a variation of an output potential of said first-output-stage transistor; and a second current mirror circuit having a second input-stage transistor through which said output current flows and a second output-stage transistor operably connected to said second input-stage transistor, said second output-stage transistor being connected to said first output-stage transistor in series, wherein said error amplifier comprises:

an error detector transistor, its gate being adapted to receive an output potential of said first or second output-stage transistor; and a third current mirror circuit having a third input-stage transistor connected to said error detector transistor in series and having a third output-stage transistor operably connected to said third input-stage transistor and connected to said second input-stage transistor in series.

2. A stabilized current mirror circuit comprising:

a first current mirror circuit having a first input-stage transistor and a first output-stage transistor operably connected to said first input-stage transistor;

an error amplifier its output current changing in response to a variation in its input;

a second current mirror circuit having a second input-stage transistor through which said output current flows and a second output-stage transistor operably connected to said second input-stage transistor, said second output-stage transistor being connected to said first output-stage transistor in series; and a norator connected between said first output-stage transistor and said second output-stage transistor, wherein said norator providing said input potential of said error amplifier.

3. A stabilized current mirror circuit according to claim 2, wherein said first input-stage transistor itself is connected to form a diode, and a control input of said first output-stage transistor is connected to a control input of said first input-stage transistor, and wherein said second input-stage transistor itself is connected to form a diode, and a control input of said second output-stage transistor is connected to a control input of said second input-stage transistor.

4. A stabilized current mirror circuit according to claim 3, wherein each of said first input-stage transistor, said first output-stage transistor, said second input-stage transistor, said second output-stage transistor and said error detection transistor is an MOS transistor.

5. A stabilized current mirror circuit according to claim 3, wherein each of said first input-stage transistor, said first output-stage transistor, said second input-stage transistor, said second output-stage transistor and said error detection transistor is a bipolar transistor.

6. A stabilized current mirror circuit according to claim 2, wherein said error amplifier comprises:

an error detector transistor, its gate being adapted to receive an output potential of said first or second output-stage transistor; and a third output-stage transistor connected to said error detector transistor in series, operably connected to said first input-stage transistor to configure substantially a third current mirror circuit together with said first input-stage transistor; and a transistor connected to said second input-stage transistor in series, its control input being adapted to receive a potential between said error detector transistor and said third output-stage transistor.

7. A stabilized current mirror circuit according to claim 2, wherein said norator is a third output-stage transistor of a third current mirror circuit.

8. A stabilized current mirror circuit according to claim 7, wherein said third current mirror circuit further comprises a third input-stage transistor connected to said first input-stage transistor in series and operably connected to said third output-stage transistor.

* * * * *